US006128799A

United States Patent [19]

Nagata et al.

[11] Patent Number: 6,128,799

[45] Date of Patent: Oct. 10, 2000

[54] CONDUIT INTERIOR SMOOTHING DEVICE

[76] Inventors: Yukiaki Nagata, 243 Masuda; Masanori Kanemitu, 1357-1 Daikaijino; Tadashi Kanayama, 111 Eguchi, all of Uozu-shi, Toyama-ken, 937; Kouichi Itoh, 31 Tajimano, Kamiichi-machi, Naka-niikawa-gun, Toyama-ken, 930-03, all of Japan

[21] Appl. No.: 08/707,665

[22] Filed: Sep. 4, 1996

[30] Foreign Application Priority Data

Oct. 20, 1995 [JP] Japan ..... 7-281676
Jul. 12, 1996 [JP] Japan ..... 8-183139

[51] Int. Cl.[7] ..... B08B 9/045

[52] U.S. Cl. ..... 15/104.12; 15/104.31; 134/167 C

[58] Field of Search ..... 15/104.12, 104.31; 134/167 C, 168 C

[56] References Cited

U.S. PATENT DOCUMENTS

| | | | |
|---|---|---|---|
| 1,182,187 | 5/1916 | McEldowney | 15/104.12 |
| 1,549,761 | 8/1925 | Fuchs et al. | 15/104.12 |
| 4,747,452 | 5/1988 | Clark | 15/104.12 X |
| 4,763,376 | 8/1988 | Spurlock, Jr. et al. | 15/104.31 |
| 5,086,842 | 2/1992 | Cholet | 134/107 C X |

FOREIGN PATENT DOCUMENTS

| | | | |
|---|---|---|---|
| 52270 | 5/1982 | European Pat. Off. | 15/104.31 |
| 62-2149 | 1/1987 | Japan . | |
| 7-151265 | 6/1995 | Japan . | |
| 185491 | 7/1995 | Japan . | |
| 293093 | 1/1971 | U.S.S.R. | 15/104.12 |

*Primary Examiner*—Mark Spisich

[57] ABSTRACT

A smoothing device, according to the present invention, is used to perform smoothing in a conduit line, or the like. The smoothing device has a fluid pressure motor with a cutter attached to its output shaft and guide rollers for guiding the smoothing device in the longitudinal direction of the conduit line. Prescribed ones among the guide rollers are relatively movable in the radial direction of the conduit line by fluid pressure cylinders, springs, or the like, and pressed against the inner wall of the conduit line. The remaining guide rollers are fixed to the smoothing device with respect to the radial direction of the conduit line so as to have an automatic aligning mechanism, thereby keeping the rotatable cutter along the center of the conduit line. In the fluid pressure motor, turbine and water nozzles, for injecting water to the turbine, are detachable, facilitating the replacement of worn parts. To easily advance the smoothing device, a propelling device, using a plurality of propelling shafts connected by universal joints with rollers disposed near the connected portions of the shafts and using screws, is provided. To facilitate the discharge of the removed debris and drainage, a high-pressure water jet pump is provided. The coupler absorbing the rotation is attached to the front face of the cutter thus enabling the smoothing device to be towed in the direction of the cutter with a rope.

4 Claims, 10 Drawing Sheets

CONDUIT INTERIOR SMOOTHING DEVICE

FIELD OF THE INVENTION

This invention relates to a unit which is equipped with a fluid pressure motor having a cutter mounted on an output shaft, and it is placed within sewer pipes or underground pipes for cables which are buried underground, to move in the interior of such pipes to smooth the pipe interior by rotating the cutter, to remove foreign substances including hard substances, or to wash the interior.

BACKGROUND OF THE INVENTION

Conduit lines or sewer pipes which are buried underground sometimes have concrete flowed together with water solidified within them, and a gap between the conduits because a joint of the conduits are displaced due to ground subsidence or road construction, or deviated levels between the connected conduits. Besides, a solidifying chemical fed may leak into a pipe through a gap to form a solidified substance within the pipe, or tree roots could invade pipes to block them. Therefore, it is necessary to smooth the pipe interior for remedying the deviated levels of the pipes, cutting and removing foreign substances from the pipe interior, or washing the pipe interior. In replacing old cables in an underground conduit line with new cables, the old cables must be cut and removed because the old cables sometimes block the pipe interior and cannot be pulled out.

In order to meet the above requirements, the following methods have been employed.

A first one uses a water jet, and a second one inserts into a conduit line a device equipped with a shaft which is provided with a cutter or drill at its end and rotates the shaft by an electric or hydraulic drive source positioned outside of the conduit line. Another method was also used in which a cutter was mounted on an output shaft of a hydraulic motor, and inserted into a conduit line to smooth, remove or wash.

But, such conventional methods had the following disadvantages. First, the fluid cleaning with a water jet was hard to smooth a hard substance. But, this problem was solved to some extent by rotating the jet nozzle and also controlling its rotation. However, the impact force of the water jet alone was insufficient to satisfactorily smooth firmly solidified concrete or mortar within a conduit line.

To solve such a problem, a cutter may be rotated to provide a high cutting force. For a device which uses such a rotating cutter, a method employed transmits the rotation of a drive source disposed outside of the conduit line to the cutter at the front end through several shafts and performs smoothing. But, since this method suffers from a heavy loss of power because of deformation of the shafts and also workability is lowered, the drive force is required to have a high power, and many workers are required in charge. Besides, when a conduit line is curved, there is a fear of a damage to the conduit line because the shafts or joints are contacted with the interior of the conduit line.

When the hydraulic motor having the cutter mounted on the output shaft is inserted into a conduit line, oil hydraulic hoses are required to be two for feeding and returning, causing the conduit interior complicated when they are inserted into the conduit line.

To remedy the above disadvantages, the applicant of this invention has disclosed a hydraulic motor having a high-precision small turbine which is rotated at a high speed with water under a high pressure and a low flow rate in Japanese Patent Publication No. 62-2149. This hydraulic motor is used as an underwater hand tool with a hammer, grinder, drill, impact wrench or the like mounted at the end of the motor, and a cast turbine is used to rotate the tool at the end.

As shown in FIG. 8, a hydraulic motor 39*a*' has a high-pressure water feed port 27', a turbine 25', a water nozzle 26', and a low-pressure water discharge port 28'. This hydraulic motor is configured to supply pressurized water from the high-pressure water feed port 27', inject the pressurized water to the turbine through the water nozzle 26' to rotate the turbine, and drive the hydraulic motor 39*a*'. The turbine 25' and the water nozzle 26' are produced by welding or casting.

The applicant has also disclosed a smoothing device which uses the cast turbine motor of the above hydraulic motor to enable the insertion into a conduit line and is provided with a discharge injection mechanism to discharge removed debris and to propel itself in Japanese Patent Application No. 5-350036.

As shown in FIG. 10, this smoothing device is configured that a cutter 5*a*" is mounted as cutting means on an output shaft at the end (a travelling direction) of a hydraulic motor 39*a*" as hydraulic drive means, high-pressure water is supplied from a high-pressure water feed device through a high-pressure water hose 4*a*" to drive the high-power hydraulic motor 39*a*" by the water pressure, and the cutter 5*a*" mounted on the end of the output shaft is rotated.

Smoothing work using this smoothing device is performed as follows. Namely, smoothing is performed by the cutter 5*a*" which is drivably connected to and rotated by the hydraulic motor 39*a*" through the output shaft. Then, the smoothed portion is washed by the pressure of water injected from low-pressure injection nozzles and a high-pressure nozzle which are open toward a direction of the motor travels, and the removed debris is discharged backward from a low-pressure injection nozzle and high-pressure injection nozzles which are open backward. A propelling shaft 3*a*" is attached to a propelling shaft moving apparatus and is composed of a plurality of connecting shaft elements 3*b*", 3*c*", . . . connected by universal joints 43". Rollers 42" are disposed in the vicinity of connected portions, contacting the conduit interior, so that the propelling shaft moves in the conduit interior easily and that the propelling force can be transmitted by the propelling shaft 3*a*" easily. By the smoothing device using this small hydraulic motor, smoothing can be performed continuously, technologies concerning removal of hardened wastes from pipes in public works were extremely improved.

But, in the case of the device which smooths by the rotating cutter as disclosed in Japanese Patent Application No. 5-350036, the cutter is not always positioned at almost the center of the pipe interior, and there is a fear of a damage to the pipe interior due to an undesirable contact with the inner wall of the pipe which is in appropriate position when the device itself is displaced from the center position exceeding a prescribed level or the cutter is tilted because of irregularity of the pipe, uneven substances remained without being removed by the cutter, or accumulation of foreign substances.

Besides, since the smoothing device disclosed in Japanese Patent Application No. 5-350036 has a cylindrical motor, the removed debris tends to be caught on the outer periphery of the motor, and the front end face of the motor which is travelling is readily blocked by the debris within the pipe. Therefore, to use the hydraulic motor for the smoothing device, the appearance of the hydraulic motor or that of a device using the hydraulic motor still needs to be improved.

Since a conventional hydraulic motor used for the smoothing device is driven by a water pressure, there is an inevitable problem that the turbine and the water nozzle have a shortened service life because of the water pressure, and they must be replaced frequently. Regardless of such disadvantages, the conventional turbine and water nozzle are produced by casting or welding, making their maintenance troublesome.

Besides, when a conduit line is long or substances to be cut and removed are rigid, there is another problem that the removed debris cannot be discharged easily. When a conventional smoothing device which does not have discharge means is used, every after removing a certain amount of rigid substances, it is necessary to pull the cutter bit out of the pipe and to discharge the removed debris from the pipe.

To remedy such a disadvantage, Japanese Patent Laid-Open Publication No. 7-75228 discloses another smoothing device. This smoothing device has a hydraulic motor which provides cutting blades with a rotating force, and discharges the removed debris resulting from smoothing by the drainage from the hydraulic motor and by causing a water flow within a smoothed hole by the high water pressure injection nozzle provided on the hydraulic motor.

However, in the smoothing device disclosed in Japanese Patent Laid-Open Publication No. 7-75228, the flow rate of the drainage within the smoothed hole is decreased as separated from the injection nozzle and when the removed debris has a high specific gravity, it was feared to settle and block the smoothed hole. And, a propelling shaft and a high-pressure water hose which are connected to the hydraulic motor are inserted into the smoothed hole, but when the drainage has a slow flow rate, the removed debris is involved in the drainage to block the pipe.

And, since long and continuous debris which is produced when waste such as plastics is removed is easy to block a pipe, it is necessary to intermittently perform smoothing, or lower a smoothing speed, thereby lowering the smoothing efficiency.

When a pipe has a hole, a curve or inclination, water tends to accumulate within the pipe, and it is necessary to drain the pipe after smoothing. And, when a feeder which has one feed threaded shaft is a rack and pinion type, its attaching direction is limited, and when the threaded feeder is an ordinary one, a guide mechanism for preventing a moving element from turning together is required. Thus, it is disadvantageous that the structure is complicated, and its weight is increased, resulting in poor transportability.

And, it is impossible to tie a rope to the front of the cutter of the device and pull it in the longitudinal direction of the pipe conduit because the rope is twisted due to the rotation of the cutter. Therefore, the device can be pulled only to the side opposite from the cutter, and this is inconvenient for using the device.

There is also a disadvantage that when the cutter is placed within the pipe conduit, the whole device is not always visible, and even when the cutter comes in contact with the inner wall of the pipe, it cannot be known whether the cutter is at a position where the connected pipes are not on the same level or the cutter is not at about the center of the pipe, causing an unnecessary contact.

SUMMARY OF THE INVENTION

The invention is to remedy the above-described disadvantages, and a first object of the invention is to provide a conduit interior smoothing device having a hydraulic motor for rotating a cutter, which is provided with means to smoothly perform the discharge of removed debris, the forced movement of the device and to guide the device to the longitudinal direction of the pipe conduit.

In addition to this, a second object of the invention is to provide a conduit interior smoothing device which has an automatic aligning mechanism.

In addition to this, a third object of the invention is to provide a conduit interior smoothing device which can be moved smoothly after the smoothing operation is finished.

A fourth object of the invention is to provide a conduit interior smoothing device in which removed debris and drainage can be discharged successively, the removed debris discharging work is omitted, work becomes highly efficient, a burden on workers can be reduced, the removed debris and the drainage can be collected and discharged with substantially no removed debris or no drainage remained in a smoothed hole or a conduit line, thereby enabling to reduce a total amount of water by recycling the used water.

A fifth object of the invention is to provide a conduit interior smoothing device in which a hydraulic motor includes an improved turbine and water nozzles, resulting in a compact size, being highly powerful, having a long life, and it is durable against the use for smoothing work in adverse environments. A sixth object of the invention is to provide a conduit interior smoothing device in which a propelling mechanism is of small size because it is light-weight and simple in structure, and has propelling shaft elements whose propelling shaft and joints do not come in contact with the inner wall of a conduit line when it is curved.

A seventh object of the invention is to provide a conduit interior smoothing device which can be pulled from either side of a conduit line in its longitudinal direction.

To achieve the first object, the conduit interior smoothing device of the invention comprises a fluid pressure motor having a cutter mounted on an output shaft and being driven with a high-pressure fluid, moving means for forcedly advancing a device, removed debris discharge means using means using the high pressure fluid, and guiding means for guiding a device in the longitudinal direction of a conduit line.

To achieve the second object, in the conduit interior smoothing device of the invention, the guiding means has device front guide rollers and device rear guide rollers, each at least three, and the front guide rollers disposed on the lower half of the smoothing device are engaged with the device body via a spring as irregularity absorbing means and movable in the radial direction of the conduit line.

To achieve the third object, in the conduit interior smoothing device of the invention, the guide rollers, which are fastened by a fluid pressure cylinder and movable in the radial direction, are provided on the front upper half and rear upper half of the device, and the high-pressure fluid for operating the fluid motor also operates the fluid pressure cylinder. To achieve the fourth object, in the conduit interior smoothing device of the invention, the removed debris discharge means are provided with injection nozzles which separately inject the high-pressure fluid to flow the removed debris toward the rear of the device, and a jet pump which uses a negative pressure produced by the jet flow of the separated high-pressure fluids in order to absorb the removed debris and increases the pressure to discharge the removed debris out of the conduit line.

To achieve the fifth object, in the conduit interior smoothing device of the invention, the fluid pressure motor includes a turbine and water nozzles for injecting water to the turbine, the turbine and the water nozzles are detachable, the turbine comprises a turbine body and a turbine cap, and they are connected to the output shaft with nuts, while the water nozzles are formed in multiple numbers by combining a casing, which has a plurality of grooves at the end face, with the body. To achieve the sixth object, in the conduit smoothing device of the invention, the moving means have a plurality of propelling shafts connected by universal joints, rollers provided as guide means near the connected portions of the propelling shafts, and a propelling mechanism which has a plurality of feed threaded shaft arranged in parallel and moves a slider by means of the feed threaded shafts to provide the propelling shafts to provide the propelling shafts with a propelling force.

To achieve the seventh objects, in the conduit interior smoothing device of the invention, the moving means comprise a shaft coupler having a mechanism of absorbing the rotation which is attached to the center of the front face of the cutter, and a rope for pulling the device.

BRIEF DESCRIPTION OF THE DRAWINGS

FIG. 9(*b*) is an exploded view of a turbine shown in FIG. 9(*a*).

FIG. 9(*c*) is a sectional view taken on line 9*c*—9*c* of FIG. 9(*b*).

FIG. 9(*d*) is a sectional view taken on line 9*d*—9*d* of FIG. 9(*a*).

DETAILED DESCRIPTION OF THE INVENTION

Figure 1:
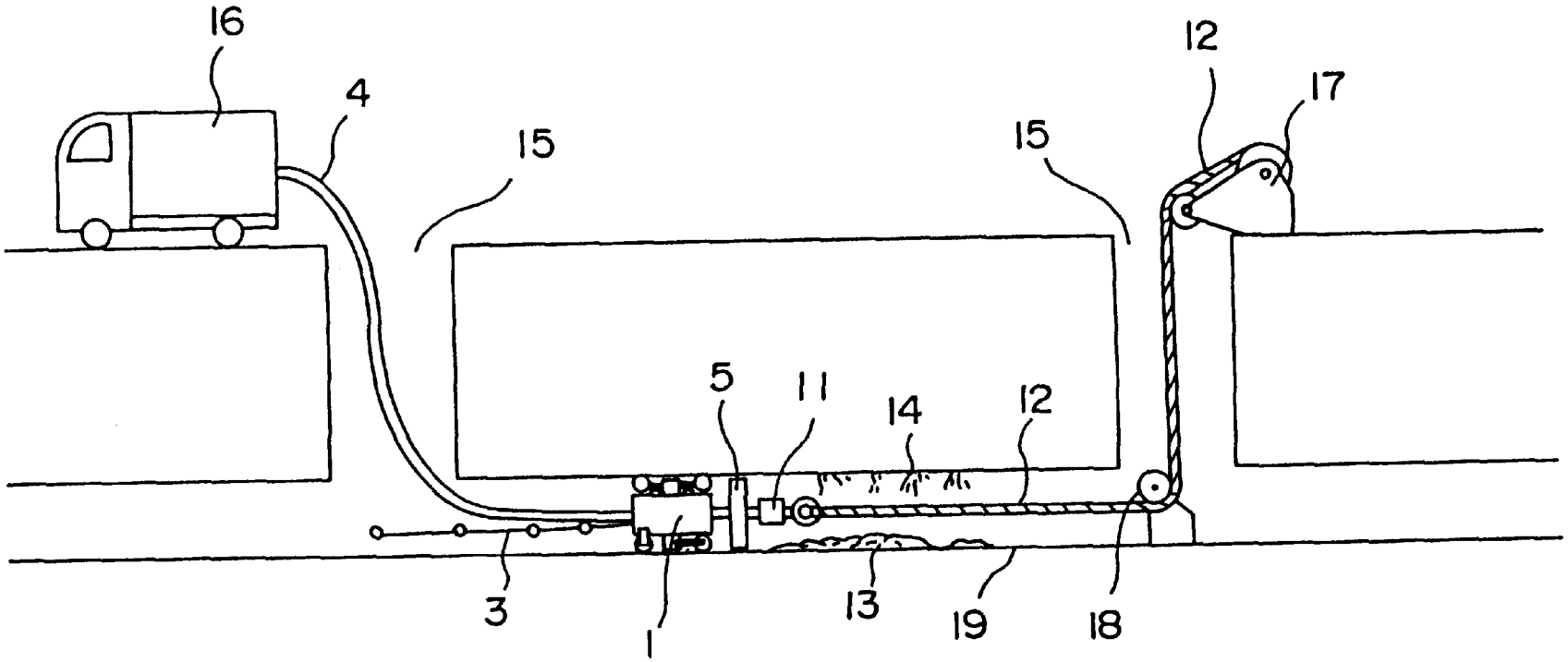
FIG. 1 is an explanatory view of one embodiment according to the invention including peripheral equipments.

Now, Example 1 of the conduit interior smoothing device according to the invention will be described with reference to the accompanying drawings. In FIG. 1, a conduit interior smoothing device 1 is positioned in a conduit line 19 under ground through a manhole 15, and moved through the conduit line 19 while rotating a cutter 5, which is attached to the front end of the device, by a hydraulic motor (not shown), to remove a foreign substance 13, tree roots 14, and a different level of the conduits caused after disposed underground. To the side of the smoothing device 1 opposite from the cutter, a high-pressure hose 4 is connected to supply high-pressure water from a high-pressure pump vehicle 16 to drive the hydraulic motor.

A rotation absorbing coupler 11 is attached to the center of the front end of the cutter 5 of the smoothing device 1, a rope 12 is tied to the coupler 11 and pulled to move the smoothing device 1 in the direction of the cutter 5. Pulling the rope 12 by a manual or automatic winch 17 positioned on the ground near another manhole 15 via an intermediate pulley 18 tows the smoothing device 1. When the smoothing device 1 is moved, the foreign substance 13, the tree roots 14, and the different level in the conduit line 19 are removed by the rotating cutter 5. The smoothing device 1 is recovered through the latter manhole 15 or moved into the next conduit toward the next manhole.

By connecting a propelling shaft 3 to the end of the smoothing device 1 opposite from the cutter, the smoothing device 1 can be pushed or pulled via the propelling shaft 3. And, when the propelling shaft 3 is connected in multiple numbers to the smoothing device 1 in order to push or pull the smoothing device 1, the smoothing device 1 can be moved for a prescribed distance without connecting a rope, and can be used to smooth a completely blocked conduit line.

Figure 2:
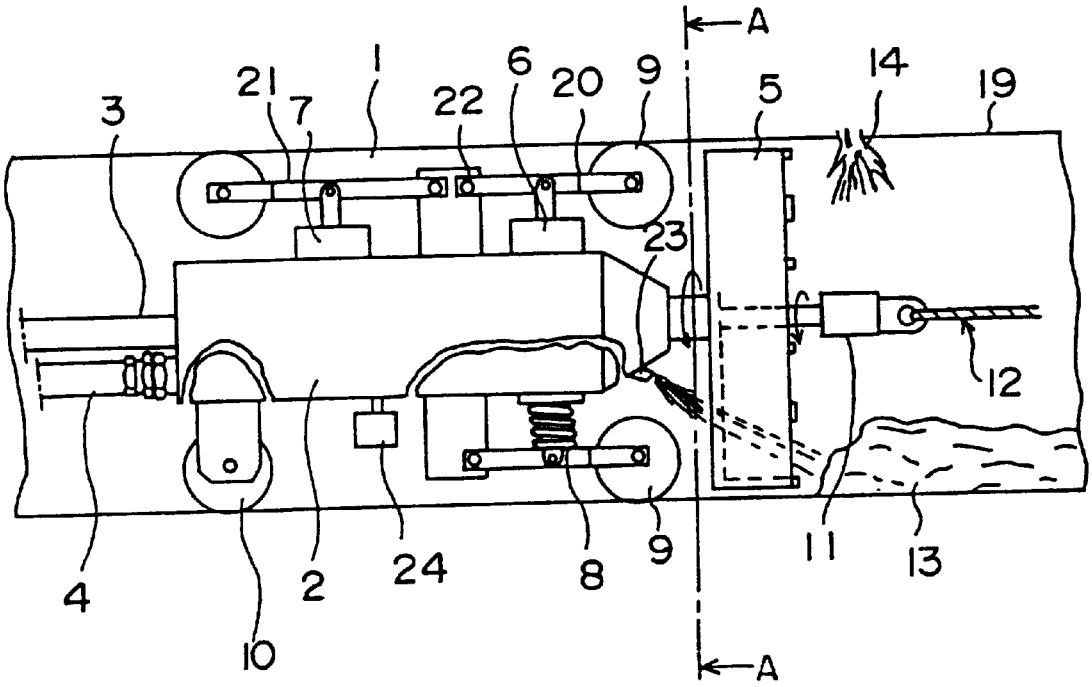
FIG. 2 is a schematic front view of the smoothing device according to one embodiment of the invention. Guide rollers at the lower half are viewed from a direction perpendicular to a plane including the device's center shaft and the guide rollers' center.

FIG. 2 shows a configuration of the conduit interior smoothing device 1. The smoothing device 1 has a hydraulic motor (not shown) in it, its output shaft is protruded from a device body 2, and the cutter 5 is rotatably attached to the output shaft. When the cutter 5 is rotated, the foreign substance 13 deposited in the conduit line 19, tree roots 14, and a different level of the conduits caused after disposing the conduit line underground are cut and removed. The outer diameter of the cutter 5 is slightly smaller than the inner diameter of the conduit line 19. High-pressure water introduced from a high-pressure water generator into the device body 2 drives the hydraulic motor and discharged. And, the high-pressure water introduced into the smoothing device body is partly injected from an injection nozzle 23 provided at the front of the device body 2 toward the lower part of the side face of the cutter 5 to cool the cutter and to wash out the removed debris. An injection water passage on the side face of the cutter is provided with several holes to let most of the injection water pass through.

The rotation absorbing coupler 11 is attached to the center of the front end of the cutter 5. The rotation absorbing coupler 11 is provided with a thrust bearing, so that one end is rotated and the other end is stopped from rotating. The rotating end is connected to the center of the front end of the cutter, and the non-rotating end has the rope 12 tied. The propelling shaft 3 can be connected to the end face of the device body 2 opposite from the cutter, and the smoothing device 1 can be moved by pushing or pulling the smoothing device 1 by the propelling shaft 3.

Figure 3:
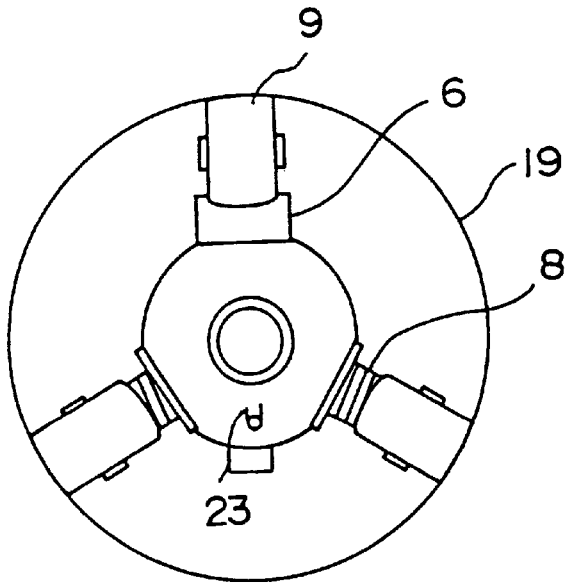
FIG. 3 is a sectional view taken on line 3—3 of FIG. 2.

The smoothing device 1 has at least three front guide rollers 9 and at least three rear guide rollers 10. The front guide rollers 9 and the rear guide rollers 10 are provided in a circumferential direction. In Example 1, one roller is on the upper half and two rollers on the lower half, three rollers in all as shown in FIG. 3, but two rollers may be on the upper half and two rollers on the lower half, four rollers in total. These guide rollers 9, 10 are in contact with the inner wall of the conduit line to guide the movement of the smoothing device 1 in the longitudinal direction in the conduit line so that the smoothing device 1 can travel smoothly. Since foreign substances tend to deposit most at about the bottom of the conduit line, the guide rollers 9, 10 are preferably mounted on the smoothing device 1 so as not to come in contact with such substances.

The guide rollers 9, 10 excepting those on the rear lower half of the smoothing device 1 have one end of horizontally disposed arms 20, 21 connected by means of a pin, and the other end of the arms 20, 21 is connected to a projection at about the center of the smoothing device body 2 by means of a pin 22. The guide rollers 9, 10 are vertically movable with the connection pin 22 as a fulcrum.

At about the middle of the horizontal arms 20, 21 for the guide rollers on the front and rear upper halves, cylinders 6, 7 are connected to the smoothing device body and provided with a communication port through a joint so that the high-pressure water introduced into the smoothing device body is also introduced into the cylinders. Besides, each piston in the cylinders is connected to the horizontal arm via a pin, so that when the smoothing device is operated, the high-pressure water is introduced into the cylinders to push the pistons to apply a force to the guide rollers, which are forced against the inner wall of the conduit line.

To the horizontal arms 20 for the guide rollers for the front lower half, the bottom end of a lever supported by a spring 8 is connected via a pin. The top end of the spring 8 is also connected to the smoothing device body 2 via a pin. The vertical lever is inserted into the spring 8 and when the horizontal arm 20 is tilted according to the vertical movement of the guide roller 9, the force applied to the guide roller is variable according to the extension or contraction of the spring 8. Even when the force due to the weight of the smoothing device body 2 is applied, the horizontal arm 20 is adjusted to be horizontal by virtue of the spring 8 and the vertical lever.

The guide rollers 10 at the rear lower half are simply rotatable and positionally fixed to the smoothing device body 2.

The position of the guide roller provided on the front upper half of the smoothing device via the engaging means to come in contact with the inner surface of the conduit line is prevented from being expanded to exceed the radius of the conduit line by restricting the external movement of the piston in the fluid pressure cylinder mounted on the engaging means.

To make the guide rollers 9, 10 at the front lower half and the rear upper half relatively movable with respect to the smoothing device in the radial direction of the conduit line, a force is applied by the spring 8, and the guide rollers at the front upper half and the rear lower half may have their positions fixed. The spring 8 for the guide roller at the rear upper half may be mounted in a compressed state to make adjustment, so that a force is applied to the guide roller 10 when the horizontal arm 21 is horizontal.

In the arrangement of the guide rollers of the device of the invention, the guide rollers at the rear of the device are positioned away from the cutter part in the axial direction of the device. Thus the different levels of the conduit cause less amount of the shift of the cutter center since the distance between the front and rear guide rollers is fairly large compared with that of the front guide rollers and the cutter part. Furthermore, since the influence of the different levels of the conduits are absorbed by the fluid cylinder or the spring which engage the guide rollers at the rear upper half with the device, the cutter part is maintained in a position at about the center of the conduit line enabling to have trouble free smoothing operation.

When the guide rollers at the front lower half and rear upper half of the smoothing device are designed to relatively move in the radial direction of the conduit line with respect to the smoothing device in order to absorb unevenness on the inner surface of the conduit line and the guide rollers at the front upper half and the rear lower half of the smoothing device are designed to move along unevenness on the inner surface of the conduit line without absorbing the unevenness on the inner surface of the conduit line so as to prevent or suppress the relative movement in the radial direction of the conduit line with respect to the smoothing device, thereby providing the most preferable automatic aligning mechanism.

For example, all the guide rollers at the front of the smoothing device may be relatively movable in the radial direction of the conduit line. The guide roller at the front upper half of the smoothing device may be fastened by a fluid pressure cylinder. The exterior travel of the piston in the fluid pressure cylinder may be restricted so that the contact points of the guide rollers with the inner surface of the conduit line do not reach beyond the radius of the conduit line. The guide rollers at the front lower half of the smoothing device may be engaged with the smoothing device via a spring, the guide rollers at the front upper half of the smoothing device may be pushed toward the inner surface of the conduit line, with a force higher than that of the guide rollers at the front lower half of the smoothing device. In this case, the guide rollers at the front upper half of the smoothing device are usually at the restricted position and the guide rollers at the front lower half of the smoothing device make relative movement with respect to the smoothing device in the radial direction of the conduit line. The guide rollers at the front upper half of the smoothing device do not easily make relative movement with respect to the smoothing device in the radial direction of the conduit line. The vertical movement at a point near the guide roller of the horizontal arm 20 for the guide rollers 9 at the front upper half and the front lower half may be detected by a limit switch attached to the smoothing device body, so that the contact of the limit switch can be made to operate just before the guide rollers 9 come to a location where the cutter 5 and the inner surface of the conduit line 19 properly positioned are contacted.

The hydraulic motor's internal components for the smoothing device can be configured, so that the center of the rear half of the smoothing device from the projection at almost the middle of the smoothing device to which the arm is connected comes to below the center of the rotatable cutter which is aligned with almost the center of the conduit line, and a weight 24 can also be attached to almost the middle of the bottom of the smoothing device body 2. Thus, the center of gravity of the smoothing device is lower than the middle of the smoothing device, and when the work is completed and the smoothing device is pulled by a rope or the like with the top guide rollers under no load, the smoothing device body can be kept in a proper vertical position and the entire device body 2 is stabilized so as not to turn due to the cutter's reaction force.

A worm or a gear can be attached to the inner side of the cutter of the output shaft of the hydraulic motor to rotate the rollers via a gear provided coaxially with the roller in synchronism with the rotation of the cutter, so that the smoothing device can be self-propelled.

Now, Example 2 of the smoothing device of the invention will be described.

Figure 4:
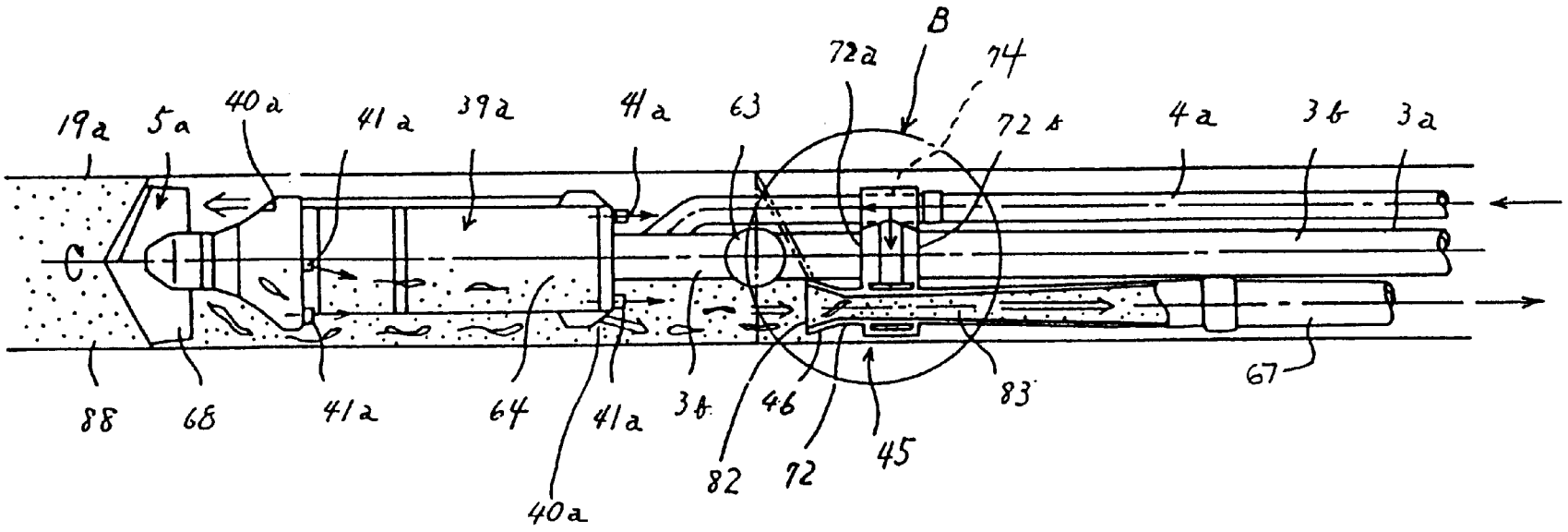
FIG. 4 is an explanatory view of the entire smoothing device according to another embodiment of the invention.
Figure 11:
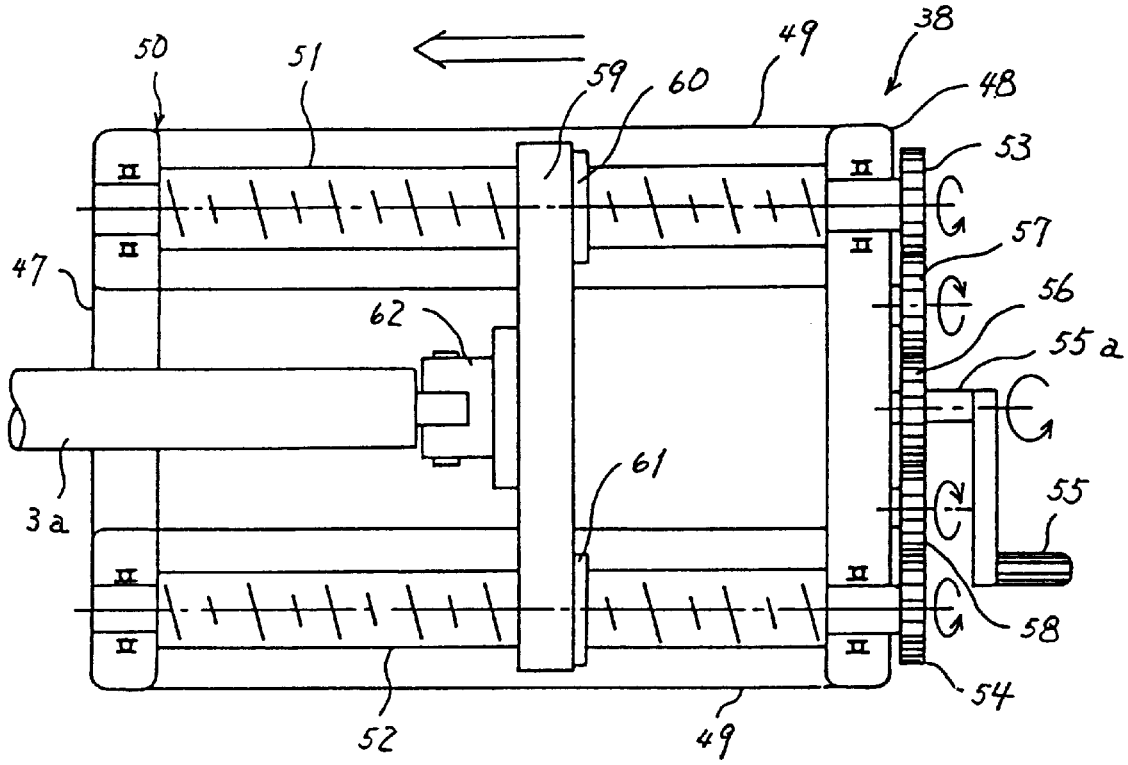
FIG. 11 is a schematic drawing of a propelling mechanism of the smoothing device of the invention FIG. 12(*a*) is an explanatory view showing relationship between a feed threaded shaft and a propelling shaft shown in FIG. 11.

FIG. 4 is an explanatory view of the entire smoothing device according to Example 2 of the invention, and FIG. 11 is a schematic view of a propelling mechanism for the smoothing device.

A smoothing device in Example 2 of the invention mainly consists of a propelling mechanism 38, a propelling shaft 3*a*, a hydraulic motor 39*a* as hydraulic drive means attached to the leading end of the propelling shaft 3*a*, a cutter 5*a* as smoothing means drivably connected to the hydraulic motor 39*a*, and a forced removed debris discharged mechanism 45 containing a jet pump 46 as a component of the removed debris discharge means.

Figure 12:
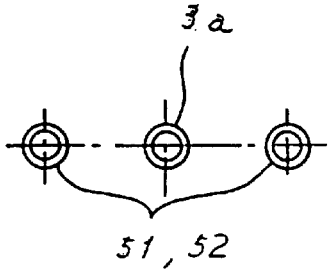
FIG. 12(*b*) is an explanatory view showing relationship between a feed threaded shaft and a propelling shaft shown in FIG. 12(*a*).
Figure 12:
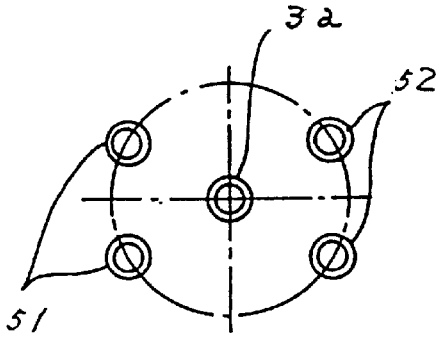

The propelling mechanism 38 has a frame 50 which has front and rear holding members 47, 48 connected by a coupling member 49 as shown in FIG. 11. The frame 50 is provided with a pair of feed threaded shafts 51, 52 which have their front and rear ends rotatably held by the holding members 47, 48. The rear ends of the feed threaded shafts 51, 52 are passed through the holding member 48 and have gears 53, 54 fixed thereto. A feed handle 55 is rotatably provided at the center of the rear holding member 48, and a drive gear 56 is fixed to a shaft 55*a* of the feed handle 55. And, the drive gear 56 is linked with the gears 53, 54 via idle gears 57, 58 which are supported by the holding member 48. The feed threaded shafts 51, 52 and the propelling shaft 3*a* may be mutually arranged as shown in FIG. 12(*b*). The feed threaded shafts 51, 52 have threaded on them nut members 60, 61 which are fixed to a slider 59, and the rear end of the propelling shaft 3*a* is connected to the center of the front end of the slider 59 via a joint member 62. The propelling shaft 3*a* is divided into a plurality of shaft elements 3*b*, and the adjacent shaft elements 3*b* are mutually connected by a joint 63 such as a universal joint, so that the propelling shaft 3*a* is flexible at the universal joints 63. And, the front end of the propelling shaft 3*a* is fixed to the center of the rear end face of a casing 64 of the hydraulic motor 39*a*.

A roller mechanism (not shown) is provided on the outer periphery of a shaft element 3*b* of the propelling shaft 3*a*. The roller mechanism comprises synthetic resin rollers each axially supported by roller supporting brackets which are disposed at certain intervals on the outer periphery of the shaft in its circumferential direction. The rollers are arranged to secure spaces for a high-pressure water hose for supplying high-pressure water to the hydraulic motor and a low-pressure discharge hose which has a larger nominal diameter than the high-pressure water hose, and these rollers are designed so that the lower rollers have a diameter larger than that of the upper rollers.

The hydraulic motor 39*a* has a turbine and a speed reducer (not shown) in it, the high-pressure water hose 4*a* is passed into the-rear face of the casing 64 of the hydraulic motor 39*a*, and the-high-pressure water hose 4*a* is connected to the inlet of the turbine. The high-pressure water hose 4*a* is substantially parallel to the propelling shaft 3*a* with the space between the upper rollers, and the high-pressure water hose 4*a* is supplied with high-pressure water from a high-pressure water supplying device (not shown).

The hydraulic motor 39*a* is provided with the low-pressure injection nozzle 40*a* and a high-pressure injection nozzle 41*a* as removed debris discharge means.

And, the cutter 5*a* is attached to the front end of the casing 64 of the hydraulic motor 39*a*.

Figure 5:
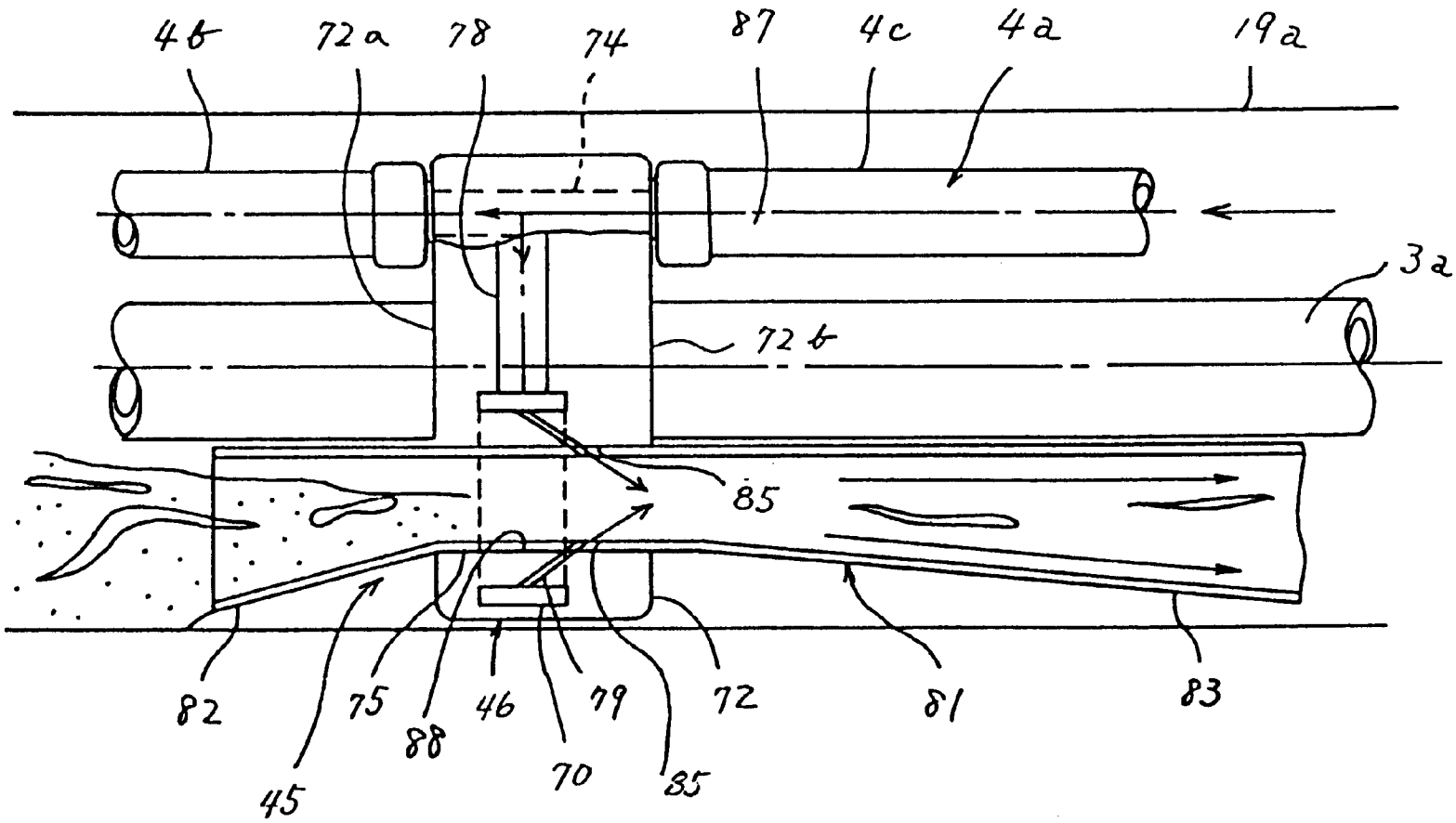
FIG. 5 is an enlarged detailed drawing of the part B shown in FIG. 4.

The, forced removed debris discharging mechanism 45 is provided with the jet pump 46 which uses a negative pressure produced by the accelerated jet flow in order to absorb the fluid and increases the pressure to discharge. This jet pump 46 has a pump body 72 as shown in FIG. 5, a main passage 74 ranging from a front face 72*a* to a rear face 72*b* is provided on the top of the pump body 72 and a housing fitting hole 75 is provided at its lower part. And, an annular chamber 70 concentric with the housing fitting hole 75 is formed on the pump body 72. The chamber 70 is communicated to the main passage 74 through a communication passage 78, and the chamber 70 is provided with a plurality of water nozzles 79 which are slanted backward and open to the housing fitting hole 75.

And, the housing fitting hole 75 of the pump body 72 has a pump housing 81 fitted with its straight pipe section 88. The pump housing 81 comprises a funnel-shaped inlet pipe 82 continued to the front end of the straight pipe section 88 and a funnel-shaped outlet pipe 83 continued to the rear end of the straight pipe section 88. And, the straight pipe section 88 has a plurality of injection ports 85 formed in the injecting direction of the water nozzles 79. To securely collect the removed debris, a mouth 46*a* of the funnel-shaped inlet pipe 82 may be opened wide as large as the conduit 19*a* as indicated by a phantom line in FIG. 4.

And, the high-pressure water hose 4*a* is divided into front and rear sections at a certain point. A front hose 4*b* of the high-pressure water hose 4*a* is connected to the front end of the main passage 74 of the jet pump 46, and a rear hose 4*c* of the high-pressure water hose 4*a* is connected to the rear end of the main passage 74. The jet pump 46 has its inlet pipe 82 positioned behind the hydraulic motor 39*a*, and a low-pressure discharge hose 67 is connected to the outlet pipe 83.

Now, the above configured smoothing device is used to smooth the interior of the conduit 19*a*.

In the propelling mechanism 38, when the feed handle 55 is rotated, the drive gear 56 is rotated, the gears 53, 54 are rotated via the idle gears 57, 58, the feed threaded shafts 51, 52 are rotated to advance the slider 59 by the feeding mechanism of the nut members 60, 61, and the hydraulic motor 39*a* is advanced by the propelling shaft 3*a*.

And, the hydraulic motor 39*a* is supplied with high-pressure water from the high-pressure water supplying device through the high-pressure water hose 4*a*. The motor or the turbine and the speed reducer housed in the hydraulic motor 39*a* is driven by the water pressure. Then, the cutting blades 68 attached to the leading end of the output shaft 35*d* are rotated to mechanically smooth the rigid waste which blocks the interior of the conduit 19. When long continuous removed debris is produced, it is pulverized by the shearing action by the stationary blades and the rotatable blades into fine removed debris which can be readily discharged. At the same time, the portion being smoothed by the cutting blades 68 is washed by the pressure of water injected from the high-pressure injection nozzle 41*a*.

Besides, the high-pressure fluid separated in the hydraulic motor is directly forced backward from the high pressure injection nozzle and drainage used for turbine drive of the hydraulic motor is discharged backward by the pressure of water injected from the low-pressure injection nozzle 40*a*, and the removed debris is forced backward with the drainage accordingly. Particularly, the high-pressure injection nozzle 41*a* and the low-pressure injection nozzle 40*a* which inject backward have a function of enhancing the action of discharging the removed debris and force the removed substances backward.

Thus, the removed debris and others forced backward are taken into the inlet pipe 82 due to a negative pressure produced by the jet pump 46, discharged from the outlet pipe 83, and externally discharged through the low-pressure discharge hose 67. In this case, different from the case of directly discharging into the conduit 19*a*, since the flow rate in the low-pressure discharge hose 67 is fast and the inner wall of the low-pressure discharge hose 67 is smooth, the removed debris and others do not precipitate under drainage and are securely discharged outside.

In other words, in this jet pump 46, high-pressure water is supplied from the high-pressure hose 4*a* to the chamber 70 through the communication passage 78 and injected as the jet flow accelerated through the plurality of water nozzles 79 into the straight pipe section 88. Therefore, the removed debris and others and the drainage are taken into the inlet pipe 82 due to a negative pressure produced by the accelerated jet flow and discharged from the outlet pipe 83 to the low-pressure discharge hose 67.

And, the removed debris or the rigid waste which is discharged by the low-pressure discharge hose 67 is discharged onto the ground by a discharging device (not shown).

Figure 6:
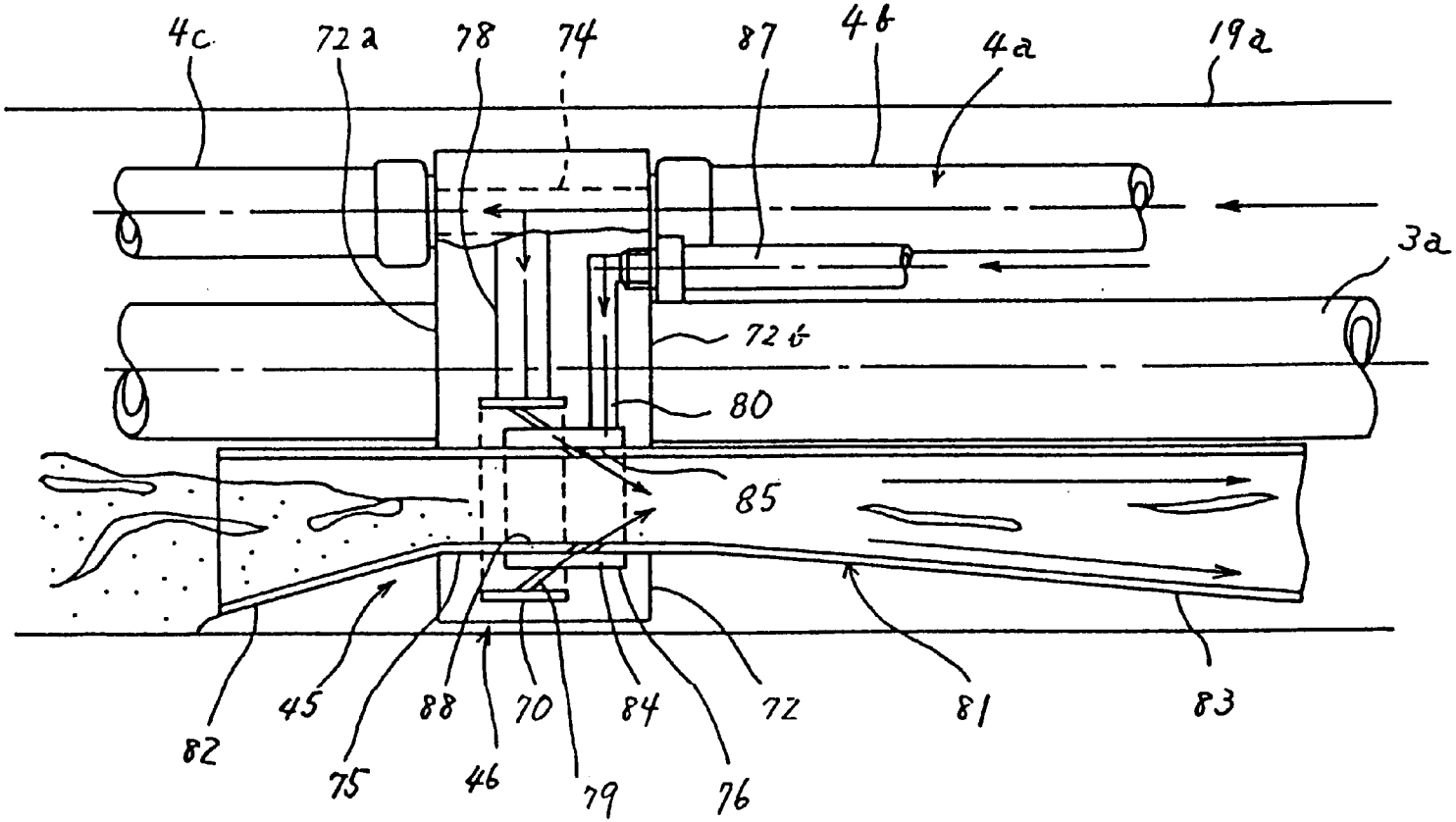
FIG. 6 is an enlarged detailed drawing of the part B shown in FIG. 4 according to another embodiment of the invention.

Another embodiment of the forced removed debris discharging mechanism 45 is shown in FIG. 6. This forced removed debris discharging mechanism 45 is provided with a jet pump 46 which uses a negative pressure produced by the accelerated jet flow to absorb a fluid and increases the pressure to discharge. This jet pump 46 has a pump body 72. A main passage 74 ranging from a front face 72*a* to a rear face 72*b* is provided on the top of the pump body 72 and a housing fitting hole 75 is provided at its lower part. And, an annular reduced section 76 is formed on the circumferential surface of the housing fitting hole 75, and an annular chamber 70 which is concentric with the annular reduced section 76 is formed on the pump body 72. And, this chamber 70 is communicated with the main passage 74 through a communication passage 78, and the chamber 70 is provided with a plurality of water nozzles 79 which are slanted backward and open to the annular reduced section 76. And, the pump body 72 is provided with an air passage 80 ranging from the rear face 72*b* to the annular reduced section 76.

The housing fitting hole 75 of the pump body 72 has a pump housing 81 fitted with its straight pipe section 88. The pump housing 81 comprises a funnel-shaped inlet pipe 82 continued to the front end of the straight pipe section 88 and a funnel-shaped outlet pipe 83 continued to the rear end of the straight pipe section 88. And, the straight pipe section 88 and the annular reduced section 76 forms an air mixing chamber 84. On the inner wall of the air mixing chamber 84, namely the straight pipe section 88, has a plurality of injection ports 85 formed in the injecting direction of the water nozzles 79.

In this jet pump 46, high-pressure water is supplied from the high-pressure hose 4*a* to the chamber 70 through the communication passage 78 and injected as the jet flow accelerated through the plurality of water nozzles 79 into the straight pipe section 88 through the air mixing chamber 84. Therefore, the removed debris and others and the drainage are taken into the inlet pipe 82 due to a negative pressure produced by the accelerated jet flow and, discharged from the outlet pipe 83 to the low-pressure discharge hose 67.

On the other hand, air is supplied to the air mixing chamber 84 from the air hose 87 through the air passage 80. Therefore, air is mixed with high-pressure injection water within the air mixing chamber 84. The high-pressure water is injected while involving ambient air, but since a resistance is lower than when directly injecting into water, an injection energy is not easily attenuated, and a more powerful Jet pump 46 is configured by a displacement effect by air (volume effect).

And, the mixed air is finely divided by the high-pressure water, and discharged together with the removed debris and drainage by means of the jet pump 46. But, since the mean specific gravity of the discharged water is reduced by mixing air, discharge (discharge from a deep hole) can be made for a long distance.

In Example 2, when an automatic aligning mechanism is provided, the number of guide rollers to be fitted is preferably three for the front and the rear of the smoothing device respectively, excepting a position which may come in contact with the bottom of a conduit.

The above smoothing device has been described to be used to remove cables from the interior of the underground conduit 19*a*. But, the smoothing device of the present invention is not limited to such use and can be used for smoothing of sewer pipes.

Now, Example 3 of the conduit interior smoothing device of the invention will be described with reference to the drawings.

Figure 7:
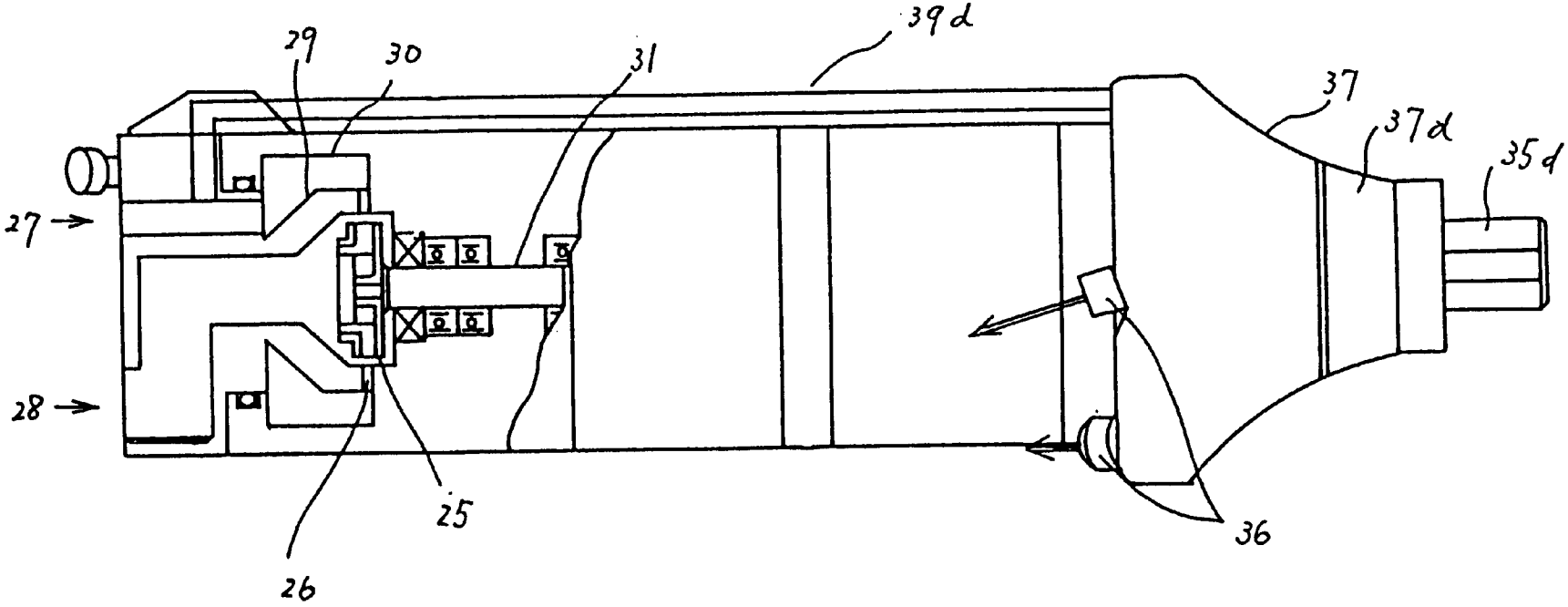
FIG. 7 is a vertical sectional view of the hydraulic motor used for the smoothing device of another embodiment of the invention.
Figure 8:
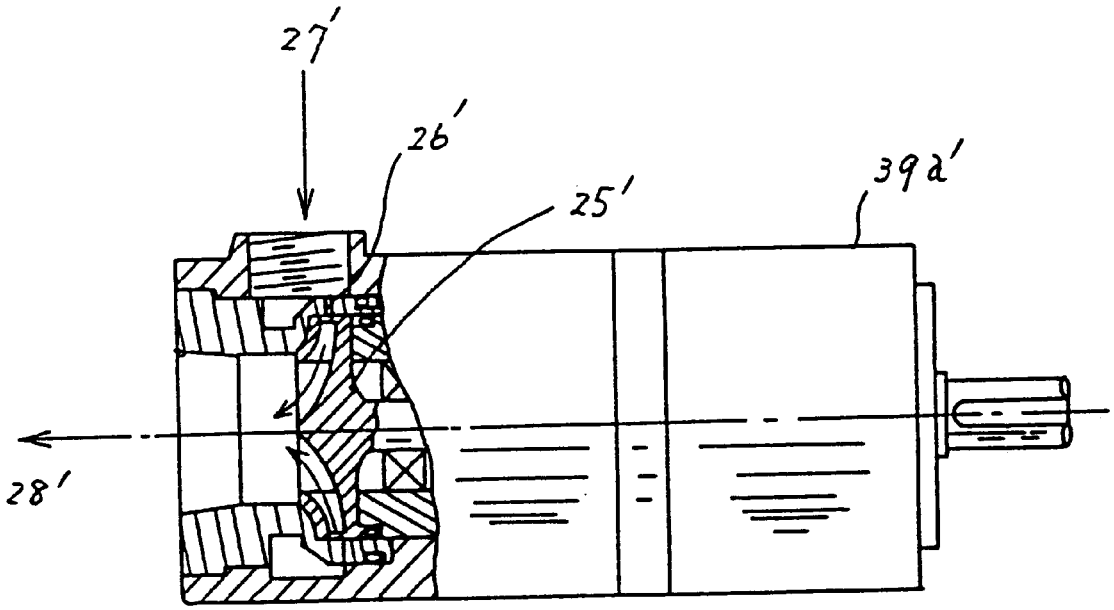
FIG. 8 is an explanatory view of a prior art hydraulic motor produced by casting and welding.
Figure 9A:
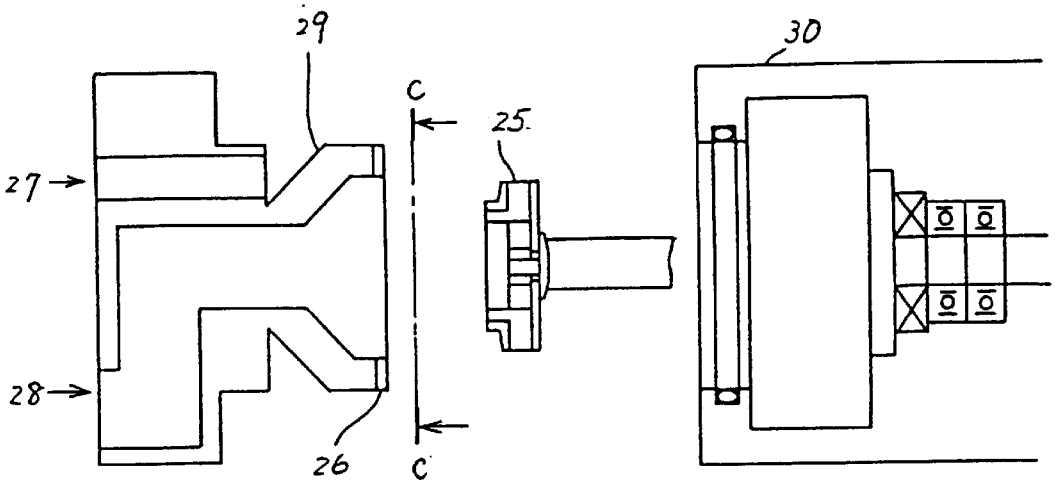
FIG. 9(*a*) is an exploded view of the detachable nozzle of the hydraulic motor used for the smoothing device of another embodiment shown in FIG. 7.
Figure 9B:
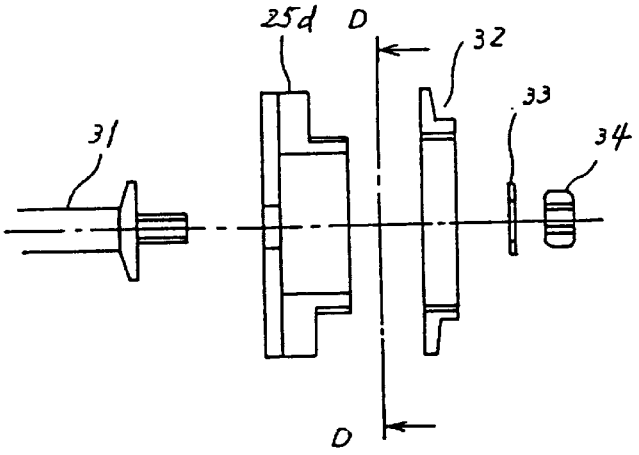
Figure 9C:
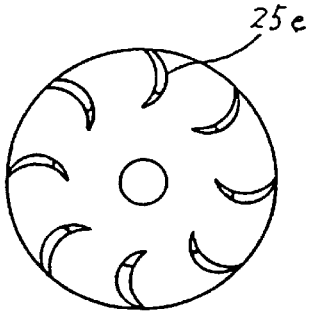
Figure 9D:
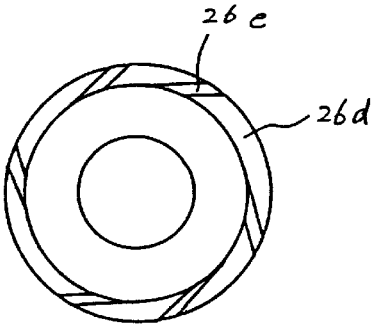
Figure 10:
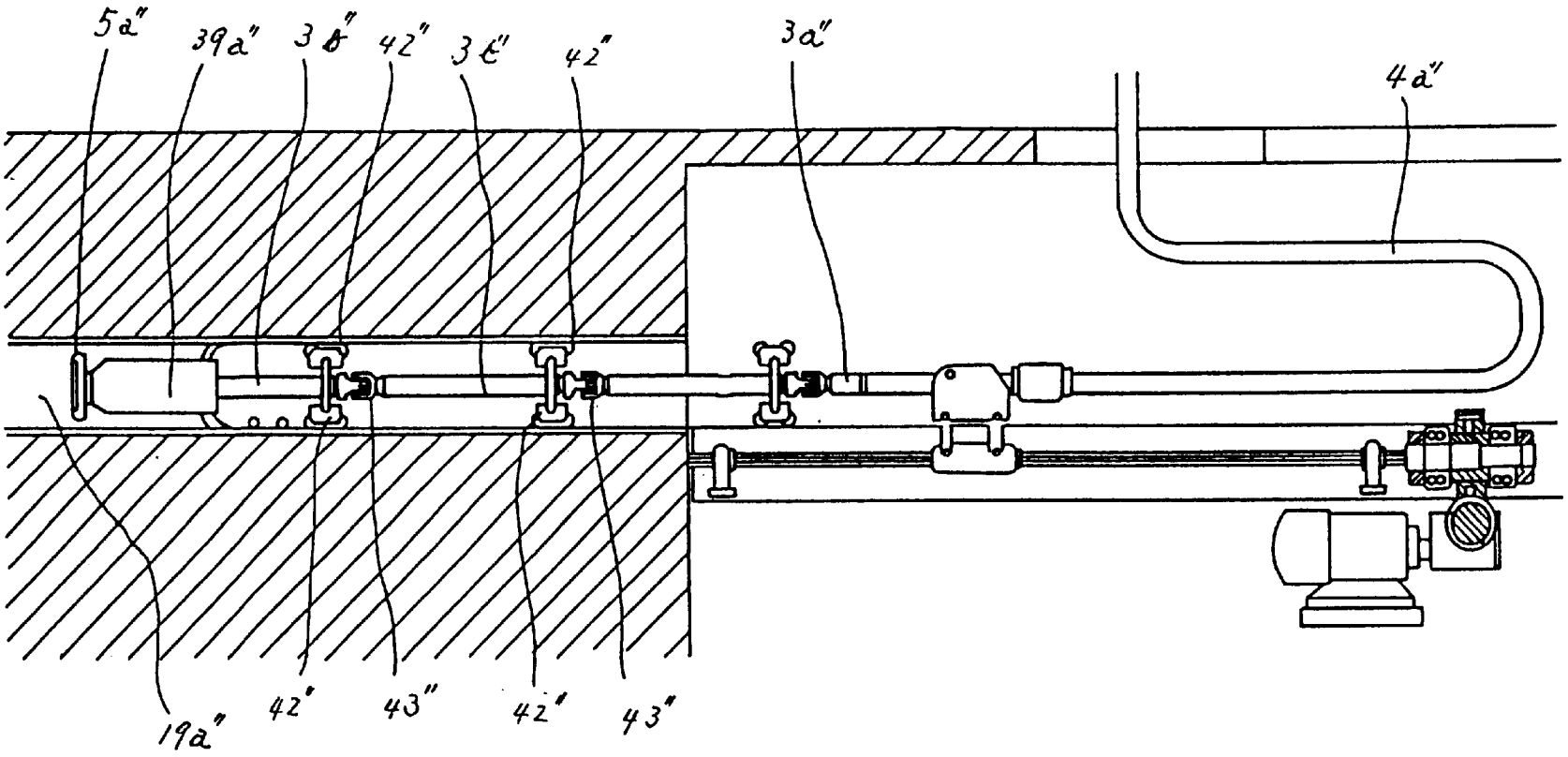
FIG. 10 is view of the entire a prior art smoothing device.

As shown in FIG. 7, a hydraulic motor 39*d* used for the smoothing device of Example 3 of the invention has a turbine 25, a casing 29 and a body 30. The casing 29 has the turbine 25 built in and is fitted to the body 30 with bolts, forming a drive for the hydraulic motor 39*d*. This drive is disposed at the rear end with respect to the travelling direction of the hydraulic motor 39*d*. The casing 29 has water nozzles 26 to inject water to the turbine 25, a high-pressure water feed port 27, and a low-pressure water discharge port 28, and the high-pressure water feed port 27 and the low-pressure water discharge port 28 are open toward the rear end of the hydraulic motor 39*d*.

As shown in FIGS. 9(*a*) and (*b*), the turbine 25 in the hydraulic motor 39*d* comprises a turbine body 25*d* and a turbine cap 32, and they are connected to a shaft 31 with a washer 33 and a nut 34. The turbine body 25*d* as shown in FIG. 9(*c*) has a plurality of turbine blades 25*e* formed.

On the other hand, the water nozzles 26 for injecting water to the turbine 25 are formed by fitting the casing 29, which has grooves 26*e* formed, to the body 30 and tightening bolts (not shown) from the rear end of the casing 29 as shown in FIGS. 9(*a*) and (*b*). As shown in FIG. 9(*d*), the grooves 26*e* are formed on the end face 26*d* of the casing 29 in a tangent direction with respect to the shaft 31. For the hydraulic motor used for the smoothing device in Example 3, six grooves 26*e* and six nozzles are formed.

The appearance of the hydraulic motor 39*d* is as shown in FIG. 7, an output shaft 35*d* is protruded toward the direction the motor is propelled, and the support of the output shaft 35*d* is covered with a conical cap 37. For a shaft seal cover 37*d* at the leading end of the cap 37, a polyethylene polymer is used as a low-friction abrasion resistant material in this example.

And, this hydraulic motor 39*d* is provided with water injection nozzles 36 as drain means. As illustrated, the injection ports are open on this side of the support and the front end of the hydraulic motor 39*d* toward the backward with respect to the travelling direction, in other words, to the reverse direction of the hydraulic motor 39*d* and in a slanted direction. The number of water injection nozzles is not restricted.

The hydraulic motor used for the smoothing device of Example 3 of the invention is operated as follows.

When pressurized water is supplied from the high-pressure water feed port 27, it is effectively injected inward from the water nozzles 26 formed in the casing 29, water accelerated in the water nozzles 26 becomes high-speed water flow to hit the turbine blades 25*e* of the turbine 25, thereby rotating the turbine 25 by the impact of water. After rotating the turbine 25, water is discharged out of the smoothing device through the water discharge port 28.

In the hydraulic motor used for the smoothing device of Example 3 of the invention, since the turbine 25 is detachable, each component of the turbine 25 can be produced by machining, so that it has higher precision than a conventional turbine produced by casting or welding and can be rotated at a high speed. Thus, the hydraulic motor can be made compact, and provided with high power.

On the other hand, to rotate the turbine 25 at a high speed, the pressurized water must be under high pressure. But, a conventional water nozzle is exposed to too excessive load to pass the pressurized water to rotate the turbine at a higher speed. And, an impact to the turbine is enormous. When the pressurized water is divided into a plurality of nozzles, a load upon each turbine blade is reduced. Namely, the more the number of nozzles is increased, the longer the life of the turbine becomes. In the detachable water nozzles 26 of the hydraulic motor used for the smoothing device of Example 3 of the invention, the injection direction and injection flow rate of water can be determined as desired by changing the direction, width and depth of the grooves 26*e* on the end face 26*d* of the casing 29. And, when the nozzle is required in multiple numbers, it is sufficient by geometrically forming the grooves 26*e* on the casing 29. Thus, by a simple work of forming a plurality of grooves 26*e* on the casing 29, the number of nozzles can be increased, and the life of the turbine can be elongated easily.

Furthermore, since the turbine 25 and the nozzles 26 are detachable, maintenance of the nozzles 26 and the turbine 25 can be made easily by removing the casing 29 from the body 30, and the parts of the turbine 25 can be easily replaced, thus, the maintenance cost can be reduced.

When this hydraulic motor 39*d* is used for smoothing work, since the conical cap 37 is used to cover the support for the output shaft 35*d* at the leading end in the travelling direction of the smoothing device, the removed debris does not block the front face of the smoothing device and is guided to the outer periphery of the motor. For the shaft seal cover 37*d* at the leading end of this conical cap 37, a low-friction abrasion resistant material such as high-molecular polyethylene is used to reduce a frictional resistance against the removed debris and to improve an abrasion resistance.

By the spiral water flow on the outer periphery of the smoothing device produced from the water injection nozzles 36, the removed debris guided to the outer periphery of the smoothing device can be discharged backward of the smoothing device without stopping to clog, and the smoothed hole or the inner wall of the conduit line can be washed effectively.

Now, an example using the hydraulic motor as a power source for smoothing work will be described.

As shown in FIG. 7, the hydraulic motor 39*d* is equipped with removed debris discharge means, namely a water injection nozzle 36 as means for discharging the removed debris by means of high pressure water.

The water injection nozzle 36 is attached to the front end of the hydraulic motor 39*d*, namely on this side of the output shaft support of the hydraulic motor 39*d* with respect to the traveling direction and has injection ports open backward and slantingly with respect to the traveling direction of the hydraulic motor 39*d* as illustrated.

Therefore, since the water injection nozzles 36 are provided as the removed debris discharge means as described above, the removed debris is forced to be discharged backward of the hydraulic motor 39*d*, and the removed hole or the inner wall of the conduit are washed.

The output shaft 35*d* which is drivably connected to the hydraulic motor 39*d* is protruded from the front end of the hydraulic motor 39*d*, and the cutter (not shown in FIG. 7) is attached to the leading end of the output shaft 35*d*.

The high-pressure water hose (not shown) which is passed through the propelling shaft (not shown) is connected to the rear end of the hydraulic motor 39*d*.

By the smoothing device of Example 3 above, the conduit interior is smoothed as follows. The propelling shaft attached to the propelling mechanism having the motor is advanced through the conduit by driving the motor, and the hydraulic motor attached to the leading end of the propelling shaft is supplied with high-pressure water from an unillustrated high-pressure water supplying device through the high-pressure water hose. The motor or the turbine and the speed reducer housed in the hydraulic motor are driven by the supplied water pressure. Thus, the cutter attached to the leading end of the output shaft is rotated to mechanically cut and remove the rigid waste which blocks the conduit interior and, at the same time, the pressure of water injected from the water injection nozzles 36 discharges water mixed with the removed debris backward. In particular, when the water injection nozzles are directed to inject in a slightly slanted direction, a spiral water flow is produced along the outer periphery of the smoothing device to provide a function of effectively discharging the removed debris around the outer periphery of the smoothing device backward, thereby forcing the debris to the exit of the conduit and also effectively washing the removed hole or the inner wall of the conduit. The removed debris or the rigid waste discharged out of the conduit is taken out to the ground by a discharging device (not shown).

In the smoothing device of Example 3 above, since the output shaft support is covered with the conical cap 37, the water injection nozzles having injection ports open in the same direction with the advancing direction of the hydraulic motor 39*d* are provided in minimum quantity to prevent the front of the smoothing device from being blocked by the removed debris. And, since the front end face of the smoothing device in the moving direction has a reduced contact resistance against the removed debris and the removed debris is effectively discharged, foreign substances such as the removed debris can be prevented from entering the turbine 25 or the water nozzle 26.

However, when working in heavy surroundings, such as smoothing work, it is hard to completely prevent foreign substances such as the removed debris from entering the hydraulic motor. But, since the above-described hydraulic motor 39*d* is used for the smoothing device of Example 3 and the turbine 25 and the water nozzles 26 are detachable, maintenance can be made by a simple work of replacing parts.

The shaft seal cover 37*d* at the front end of this conical cap 37 which covers the output shaft 35*d* cover is made of high-molecular polyethylene which is a low-friction abrasion resistant material, so that a friction resistance against the removed debris is reduced, and an abrasion resistance is improved.

The smoothing device of Example 3 has been described to be used for removing cables from underground conduits, but the smoothing device of the present invention is not limited to such use and can be used for smoothing and washing of sewer pipes.

As described above, when the smoothing device of Example 1 of the invention is used, rigid foreign substances, tree roots and others in the conduit line which cannot be removed with a water jet can be smoothed, separated and removed by the powerful cutting force of the rotatable cutter. Since the force is applied to the guide rollers to force them against the inner face of the conduit line, the smoothing force exceeding a rotation resistance produced by a dead weight can be given to the rotatable cutter without rotating the smoothing device. Therefore, a foreign substance removal power can be highly enhanced, and a smoothing work efficiency can be improved extensively.

The guide rollers are made relatively movable in the radial direction of the conduit line with respect to the smoothing device body to absorb the movement of the guide rollers in the radial direction of the conduit line caused by unevenness of the inner surface of the conduit line, irregularities without being removed by the cutter, or unevenness due to deposited foreign substances and others; and the combination with the stationary guide rollers can minimize the misalignment of the smoothing device body and keep it in a stable condition. Accordingly, the center of the cutter can be substantially held at the center of the conduit line, the cutter does not come in contact with the inner wall of the conduit line which is in a normal position, and the inner wall of the normal conduit line is not damaged.

As means for pushing the movable guide rollers against the inner wall of the conduit line by applying a force, a fluid pressure cylinder or spring is used; the former can keep a constant force even when the guide rollers are displaced due to irregularities of the inner wall of the conduit line, and the latter can increase a force in an opposite direction in proportion to the increase of displacement. Besides, by combining with the stationary guide rollers which move along the inner wall of the conduit line without absorbing the irregularities of the conduit line, a stable irregularity and bump absorbing mechanism can be provided. Thus, the smoothing device body can be prevented from being displaced from its center and the cutter center can be kept substantially at the center of the conduit line, the cutter does not touch the inner wall of the properly positioned conduit line, and the normal inner wall of the conduit line is not damaged. Therefore, a continuous smoothing work can be made with reliability.

When the high-pressure fluid is stopped from being supplied upon completing the smoothing work, the pistons of the fluid pressure cylinders come to the lowest position of the cylinders, and the guide rollers connected to the fluid pressure cylinders stop contacting the inner wall of the conduit line. Therefore, to move the smoothing device upon completing the operation, the guide rollers do not hinder the movement, and the smoothing device can be moved with ease.

Since the rotation absorbing coupler is attached to the front of the cutter, the smoothing device can be pulled in a longitudinal direction by a rope or the like from the front side of the cutter without transmitting the rotation of the cutter to the towing rope or the like, thus the work efficiency is higher than pushing the smoothing device by a shaft from the end of the smoothing device opposite from the cutter.

The removed debris can be flowed out with the discharge water or high-pressure injection water of the hydraulic motor to prevent the removed debris from depositing at the removed point, causing no obstruction against smoothing by the cutter and propelling of the smoothing device. And, the removal of foreign substances and the washing of the conduit interior can be made simultaneously. Therefore, it is not necessary to remove the smoothing device from the conduit very time debris is discharged, and work time can be extremely shortened by working continuously. And, by using a single high-pressure water line to supply water, accessories for the smoothing device can be simplified, and the smoothing device as a whole has a simple structure. Since an oil hydraulic line is not needed, there is no fear of oil leak, thus the smoothing device is effective in view of preservation of the environment.

When the cutter is placed within the conduit, the whole device is not always visible, and even when the cutter comes in contact with the inner wall of the conduit, it cannot be known whether the cutter is at a position where the connected conduits are not on the same level or the cutter is not at about the center of the conduit, causing an unnecessary contact. To remedy this disadvantage, the limit switch for detecting the vertical movement of the horizontal arm for the front guide rollers can be provided to detect the position of the front guide rollers in the radial direction in the conduit line, namely the distance between the rotatable cutter and the inner wall of the conduit line. Thus, an alarm can be issued before the cutter comes in contact with the inner surface of the conduit line which is in a normal position. Therefore, the cutter can be prevented from contacting the inner wall of the normal conduit line, the inner wall of the normal conduit line can be prevented from being damaged, and the smoothing work can be performed with reliability.

As described above, the smoothing device of Example 2 of the invention includes the cutter having cutting blades to drill substances to be removed by its rotation, the hydraulic motor for rotating the cutting blades of the cutter, the propelling shaft for propelling the smoothing device, the propelling mechanism for providing the propelling shaft with a propelling force, the discharge means flowing the removed debris backward with drainage from the hydraulic motor, the forced removed debris discharge mechanism for sucking the removed debris by using a negative pressure produced by the accelerated jet flow and discharging the removed debris by increasing the pressure. The cutting blades of the cutter are rotated by the hydraulic motor to drill the substances to be removed by the cutting blades, the smoothing device is propelled by giving the propelling shaft with a propelling force by the propelling mechanism, the removed debris is flowed backward with drainage from the hydraulic motor, the removed debris is sucked by using the negative pressure produced by the accelerated jet flow by the forced removed debris discharge means, and the removed debris is discharged by increasing the pressure.

Thus, the removed debris and the drainage can be discharged successively, eliminating the removed debris discharging work. The work becomes highly efficient, and a labor of workers can be reduced. The removed debris and the drainage can be collected and discharged with substantially no removed debris or no drainage remained in the removed hole or the conduit line, thereby enabling to reduce the total amount of water by recycling water.

And, in the smoothing device of Example 2 of the invention, the forced removed debris discharge means may be a jet pump which can provide the same effects as those described above.

In the smoothing device of Example 2 of the invention, the forced removed debris discharge means may have the jet pump and air mixing means for mixing air to the jet water flow of the jet pump, thereby providing the same effects as those described above. Besides, mixing of air and the jet water flow of the jet pump can further improve the performance of discharging the removed debris.

Furthermore, the cutter may have the cutting blades for smoothing the substances to be removed by its rotation and a crushing cutting edge having rotatable blades which rotates together with the cutting blades to shear the removed debris with the stationary blades, thereby providing the same effects as those described above. And, the removed debris which becomes long when smoothed, e.g., plastics, is finely pulverized, thereby preventing the removed debris from forming blocks.

Besides, the propelling mechanism can be proved with a structure that there are a plurality of feed threaded shafts which are rotated to move the slider to propel the propelling shaft, thereby providing the same effects as those described above. In addition, the propelling mechanism is made compact and lightweight. This propelling mechanism can be used in a small space, enabling to perform a smoothing work in a manhole for example.

Besides, in the hydraulic motor used for the smoothing device of Example 3 of the invention, the turbine and the water nozzle are detachable, so that the motor is made compact and provided with a high power, and its maintenance can be made inexpensively and easily. And, in the smoothing device of Example 3 of the invention, since the leading end of the smoothing device in the direction the smoothing device moves is conical, the smoothing device has a smooth outer periphery, and the removed debris does not block the front of the smoothing device in the direction of the smoothing device movement. Thus, the entry of foreign substances such as the removed debris into the turbine and the water nozzle of the motor can be minimized. Even if the foreign substances would enter the hydraulic motor, they can be removed by a simple maintenance of replacing the turbine and nozzle parts. Thus, this smoothing device uses the motor which can be used in adverse environments. Therefore, this device is particularly effective in smoothing work which is one of important works in civil engineering works.

What is claimed is:

1. A conduit interior smoothing device comprising a device body containing a fluid pressure motor having a cutter mounted on a projecting output shaft, said motor further adapted to be driven with a high-pressure fluid, a moving means attached to the body for forcedly advancing the smoothing device, a removed debris discharge means attached to the body, said removed debris discharge means further adapted to use said high-pressure fluid, and a guiding means attached to the body for guiding the smoothing device in a longitudinal direction of a conduit line, said guiding means further has at least three device front guide rollers and at least three device rear guide rollers, at least one of each of the at least three front guide rollers and at least three rear guide rollers are attached to a lower half of the smoothing device and at least one of each of the at least three front guide rollers and at least three rear guide rollers are attached to an upper half of the smoothing device, and all said front guide rollers disposed on the lower half of the smoothing device are engaged with the smoothing device body via a spring as irregularity absorbing means and movable in a radial direction of the conduit line and said guide rollers attached to the upper half of the smoothing device are fastened to the smoothing device by a fluid pressure cylinder and are movable in the radial direction of the conduit line, and said fluid pressure cylinder also adapted to be operated by the high-pressure fluid.

2. A conduit interior smoothing device comprising a device body containing a fluid pressure motor having a cutter mounted on a projecting output shaft, said motor further adapted to be driven with a high-pressure fluid, a moving means attached to the body for forcedly advancing the smoothing device, a removed debris discharge means attached to the body, said removed debris discharge means further adapted to use said high-pressure fluids, and a guiding means attached to the body for guiding the smoothing device in a longitudinal direction of a conduit line and wherein said removed debris discharge means further has a jet pump provided with at least one injection nozzle, said at least one injection nozzle is adapted to separately inject said high pressure fluid into the jet pump to flow removed debris toward the rear of the smoothing device, whereby said jet pump is adapted to use a negative pressure produced by the flow of the said high-pressure fluid to absorb the removed debris and increases the pressure to discharge said removed debris out of the conduit line.

3. A conduit interior smoothing device comprising a device body containing a fluid pressure motor having a cutter mounted on a projecting output shaft, said motor further adapted to be driven with a high-pressure fluid, a moving means attached to the body for forcedly advancing the smoothing device, a removed debris discharge means attached to the body, said removed debris discharge means further adapted to use said high-pressure fluids, and a guiding means attached to the body for guiding the smoothing device in a longitudinal direction of a conduit line and wherein said fluid pressure motor includes a turbine and water nozzles for injecting water to the turbine, said turbine and water nozzles are detachable, said turbine comprises a turbine body and a turbine cap, and the turbine body and turbine cap are connected to the output shaft with nuts, while said water nozzles are formed in multiple numbers by combining a casing having a plurality of grooves at an end face, with the body.

4. A conduit interior smoothing device comprising a device body containing a fluid pressure motor having a cutter mounted on a projecting output shaft, said motor further adapted to be driven with a high-pressure fluid, a moving means attached to the body for forcedly advancing the smoothing device, a removed debris discharge means attached to the body, said removed debris discharge means further adapted to use said high-pressure fluid, and a guiding means attached to the body for guiding the smoothing device in a longitudinal direction of a conduit line and wherein said moving means comprise a shaft coupler having a mechanism of absorbing the rotation which is attached to the center of the front face of the cutter, and a rope attached to the shaft coupler for pulling the smoothing device.

* * * * *